US006226914B1

(12) United States Patent
Reed

(10) Patent No.: US 6,226,914 B1
(45) Date of Patent: May 8, 2001

(54) FIREARM SAFETY APPARATUS

(76) Inventor: Waymon Burton Reed, P.O. Box 545, Sherman, TX (US) 75091

( * ) Notice: Subject to any disclaimer, the term of this patent is extended or adjusted under 35 U.S.C. 154(b) by 0 days.

(21) Appl. No.: 09/344,234

(22) Filed: Jun. 25, 1999

(51) Int. Cl.[7] ..... F41A 17/16
(52) U.S. Cl. ..... 42/70.11; 42/70.08
(58) Field of Search ..... 42/70.11, 70.08

(56) References Cited

U.S. PATENT DOCUMENTS 3,208,176 * 9/1965 Giles ..... 42/70.11
5,315,778 * 5/1994 Wolford ..... 42/70.11
5,890,310 * 4/1999 Bogstrom ..... 42/70.11
6,041,536 * 3/2000 Samuels et al. ..... 42/70.11

* cited by examiner

*Primary Examiner*—J. Woodrow Eldred

(57) ABSTRACT

The present invention is a firearm safety device designed to secure a firearm and prevent injury or death by an unauthorized user. The firearm port block is a fitted cylindrical device that when placed in the open port of a firearm prevents the firearm from being discharged. By using a positioning tab the firearm port block is placed in an open port of a firearm, expanded and locked. The open bolt supports one end of the device and the firing chamber houses the other end, blocking live ammunition. The firearm is placed in use by unlocking and removing the port block. The firearm port block is inexpensive to manufacture and easily installed and removed from an open port firearm.

1 Claim, 3 Drawing Sheets

FIREARM SAFETY APPARATUS

CROSS-REFERENCE TO RELATED APPLICATIONS

Not applicable.

STATEMENT REGARDING FEDERALLY SPONSORED RESERCH OR DEVELOPMENT

Not applicable

REFERENCE TO A MICROFICHE APENDIX

Not applicable.

BACKGROUND OF THE INVENTION

Weapons have been used for centuries to protect life and property and aid in sustaining life. Firearms allow our armies and police officers to engage in combat and different confrontations to bring about peace and harmony.

Firearms are a major cause of crime in the world today. Weapons used by young children provide a means for them to conduct mass killings in our schools and on the streets. Criminals injure, maim and kill hundreds of people each year by the use of firearms. Children playing with unsecured weapons are also maimed, injured or killed.

Our government leaders are working diligently to structure gun control laws that will allow us to live in a safer environment. One or more gun control laws being considered are safety locks and safety devices to prevent firearms from firing.

Trigger locks are safety devices used to prevent weapons from being discharged. Most trigger guards do provide a means of safety but are time consuming for someone that is required to use the weapon in an emergency situation. It is dangerous to place a trigger lock on a loaded weapon.

Many safety devices are designed to have a rod inserted in the muzzle and an attachment inserted in the firing chamber connected to the rod and pulled or tightened to swell in the weapons firing chamber. Usually, this is accomplished by twisting the rod clockwise to lock and counterclockwise to unlock, many are keyed. These type barrel devices are again, time consuming, expensive and could result in injury or death if an apparatus is being installed in a loaded weapon. A person in a hurried situation could conceivably remove the device inserted in the firing chamber and leave the rod in the barrel, chamber a round, and fire the weapon that would result in injury or death to the user.

Many devices have been invented to prevent firearms from being discharged. One such device described in U.S. Pat. No. 4,058,923, to Smith, show a safety clip attached to the handgrip of a shotgun. The clip further extends upward and into the magazine, the clip then curls back and against the shell that is ready to be injected into the firing chamber. This system would prevent semi-automatic and automatic shotguns from being fired if there is no shell present in the firing chamber before the safety clip is installed. Mr. Smith's safety device would be of little use on other firearms. For example, the device could not be mounted to a single barrel firearm or a break-over shotgun.

U.S. Pat. No. 4,654,992, to Layergne, shows a locking apparatus inserted into the magazine of a weapon with a frame extending upward with said frame having a keyed lock, when rotated, positions a lever down and into the ejection port. The art displayed by U.S. Pat. No. 4,654,992, to Mr. Layergne, limits the use of the firearm safety device to magazine type firearms.

U.S. Pat. Nos. 4,965,952 and 5,097,613 to Miller, depicts a loaded, live semi-automatic rifle cartridge, as used by the U.S. Military M-16 Rifle. Further art displays a safety plug designed similar to the M-16's cartridge and manufactured by using certain plastics or alloy materials. The art displays a visual indicator tab protruding from the ejection port that allows visual inspection to determine if a live round has been injected into the firing chamber. The safety plug is of great benefit to allow visual inspection but can be easily removed by opening the breech and manually removing the tab and plug. After removing the plug a child, adult or perpetrator would be allowed to use the weapon.

U.S. Pat. No. 5,231,236, to Del Real, is basically a rack and pinion movable device and relies largely on a key for positioning. This apparatus rests against the weapons bolt on one end and against the outside opening of the weapon's firing chamber on the opposite end. Mr. Del Real's safety device, when in the locked position allows a live shell in the weapon's firing chamber that could possibly be discharged.

Safety plugs, locking mechanisms, gun locking devices and chamber devices are disclosed in U.S. Pat. Nos. 5,014,457, 5,070,635, 4,995,180, 5,038,580, 5,419,069, 5,475,994 and 5,669,252.

It is the objective of the present invention to provide a fast and safe method for securing a firearm by blocking the ejection port and firing chamber.

REFERENCES CITED
U.S. Patent Documents

| | | | |
|---|---|---|---|
| 4058923 | Nov., 1977 | Smith | 421 LP |
| 4654992 | Apr., 1987 | Lavergne | 42/70.01 |
| 4965952 | Oct., 1990 | Miller | 42/70.01 |
| 4995180 | Feb., 1991 | Tucker | 42/70.11 |
| 5014457 | May, 1991 | Lewis | 42/70.11 |
| 5038580 | Aug., 1991 | Brown | 42/70.11 |
| 5070635 | Dec., 1991 | Cventanovich | 42/70.11 |
| 5097613 | Mar., 1992 | Miller | 42/70.01 |
| 5231236 | Jul., 1993 | Del Real | 42/70.11 |
| 5419069 | May 1995 | Mumbleau | 42/70.11 |
| 5475994 | Dec., 1995 | Briley | 70/34 |
| 5669252 | Sept., 1997 | Bentley | 70/14 |

DISCLOSURE OF THE INVENTION

The present invention is an advanced safety device for firearms. The device, when placed in the weapon's loading and ejection port, provides an extremely safe method for securing a firearm and prevents the firearm from being fired. The firearm port block apparatus is very affordable and requires a small expense to the consumer.

The firearm port block is a cylindrical device that consists of a canister and a tube and is sized to a weapons particular shell. The canister has a closed end and an open end and is hollow. The closed end of the canister next to the firearm's bolt supports a raised rim. An expandable spring is inserted into the open end of the canister nearest the firing chamber. A cylinder tube smaller in diameter than the open canister end, and having a closed end closest to the canister opening, is inserted inside the canister and against the expandable spring making for expansion and contraction of the cylinder tube inside the canister. A locking mechanism is provided to lock the cylinder in the "extended" or "compressed" position. The apparatus supports a firing cap attached to the expandable cylinder end closest to the weapon's firing chamber.

The firearm port block, in the compressed position, is placed into a weapons open port. When released from the compressed position the expanded firearm port block positions the firing cap into the firing chamber and the opposite end against the bolt. By turning the lock clockwise on the firearm port block the firearm is then in the locked position. The firearm port block is removed by reversing the locked cylinder from the expanded position to the compressed position.

BRIEF SUMMARY OF THE INVENTION

It is an object of the invention to provide a fast, economical and safe method for placing a firearm in an inoperable mode until the weapon is ready for use.

Another object of the invention is to provide a firearm port block that can be used on most open port weapons.

Another object of the invention is to provide a firearm port block that will prevent users from placing live ammunition in the weapon's firing chamber until the weapon is ready for use.

Another object of the invention is to provide a gun safety device that will allow authorized users to operate the weapon within seconds.

Another object of the invention is to provide gun manufactures an inexpensive means to secure weapons sold to the public.

BRIEF DESCRIPTION OF THE DRAWINGS

A more detailed understanding of the present invention may be had by reference to the following detailed description when taken in conjunction with the drawings wherein:

FIG. 4 drawing provides a view of the bolt ejector fastened over the raised rim of the firearm port block with the firing cap positioned in the weapon's firing chamber.

DETAILED DESCRIPTION OF THE DRAWINGS

Figure 1:
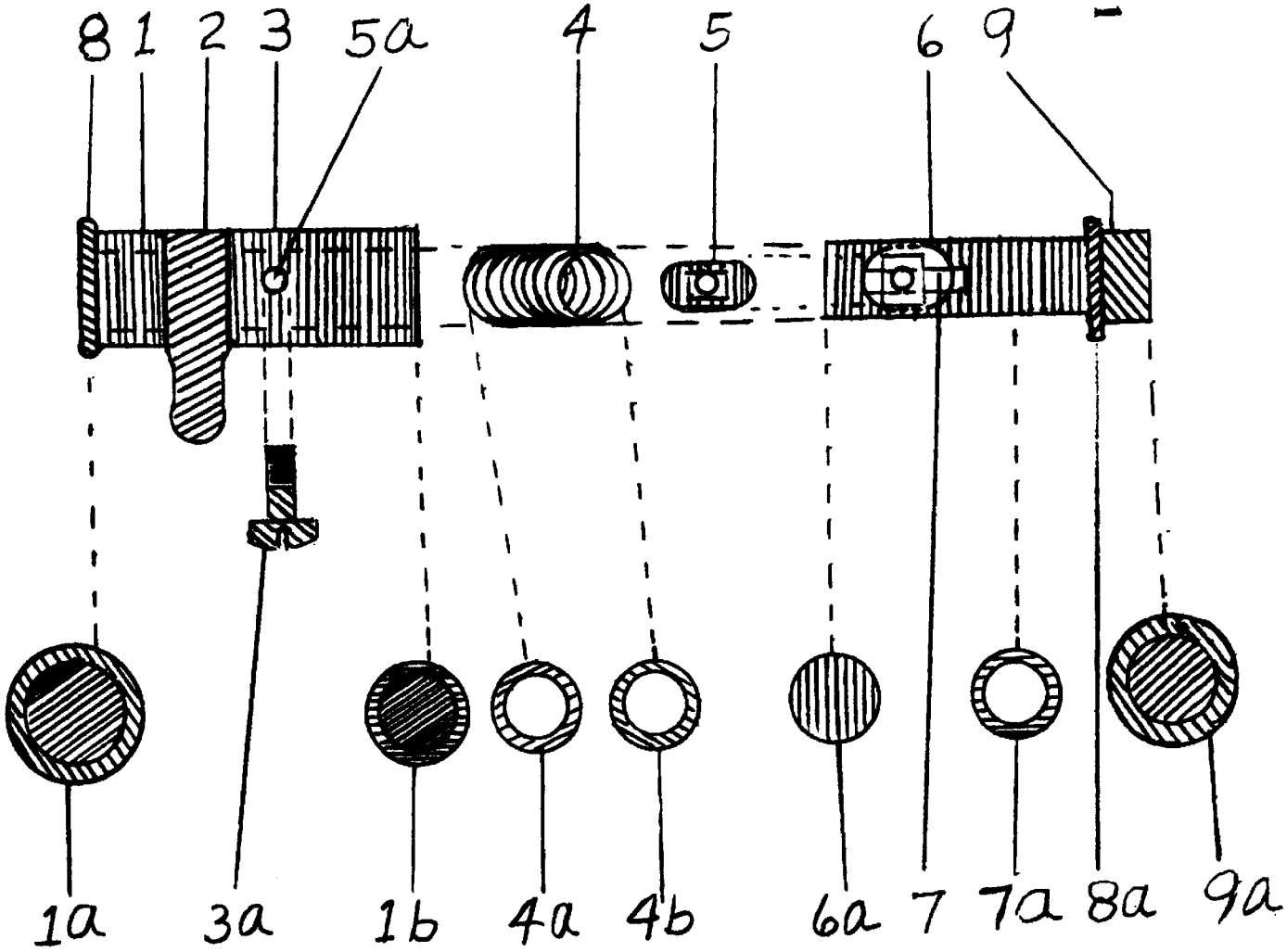
FIG. 1 is an elongated view of the firearm port block.

In FIG. 1, an enlarged, elongated view of a firearm port block 3 is shown. The firearm port block 3 is a firearm safety device fitted to a firearms particular shell.

There are four operational parts to the firearm port block 3. (1) The shell canister 1, (2) a canister spring 4, (3) a tension (lock) screw 3*a* and (4) a canister locking tube 6. The shell canister 1 is a sized cylindrical hollow tube with a closed end 1*a* that has a raised shell rim 8 and a positioning tab 2. There are two fitted holes near the center of the shell canister 1, opposite each other, and is designed to receive the tension (lock) screw 3*a*. Opposite the closed end 1*a* is a hollow opening 1*b*. The length of the hollow opening 1*b* extends the length of the shell canister 1. The design of the open canister 1*b* is to receive the canister spring 4, the canister locking tube 6, the tension (lock) screw 3*a* and the tension nut 5.

The canister spring 4 is a hollow tension spring half the length of the shell canister 1. The canister spring 4 is positioned in the hollow portion of the shell canister 1. The end 4*a* of the canister spring 4 is against the inner side of raised shell rim 8 with end 4*b* extending half the length of the shell canister 1. The function of the canister spring 4 is to provide expansion and contraction for the canister locking tube 6.

Figure 3:
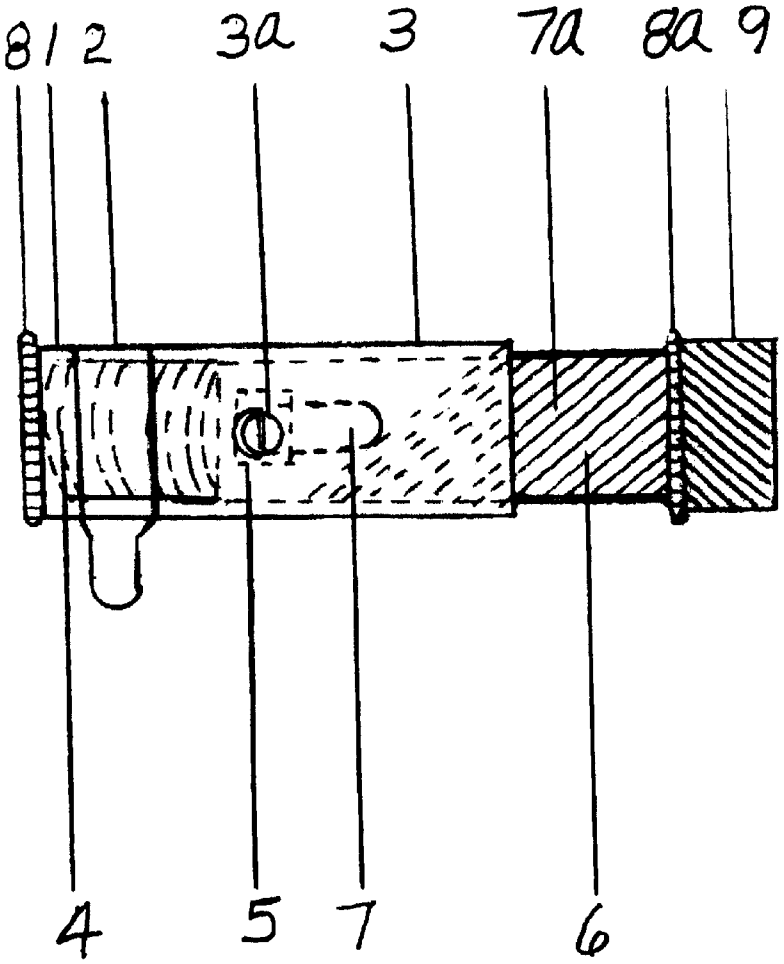
FIG. 3 is a view of the firearm port block in the expanded position.
Figure 2:
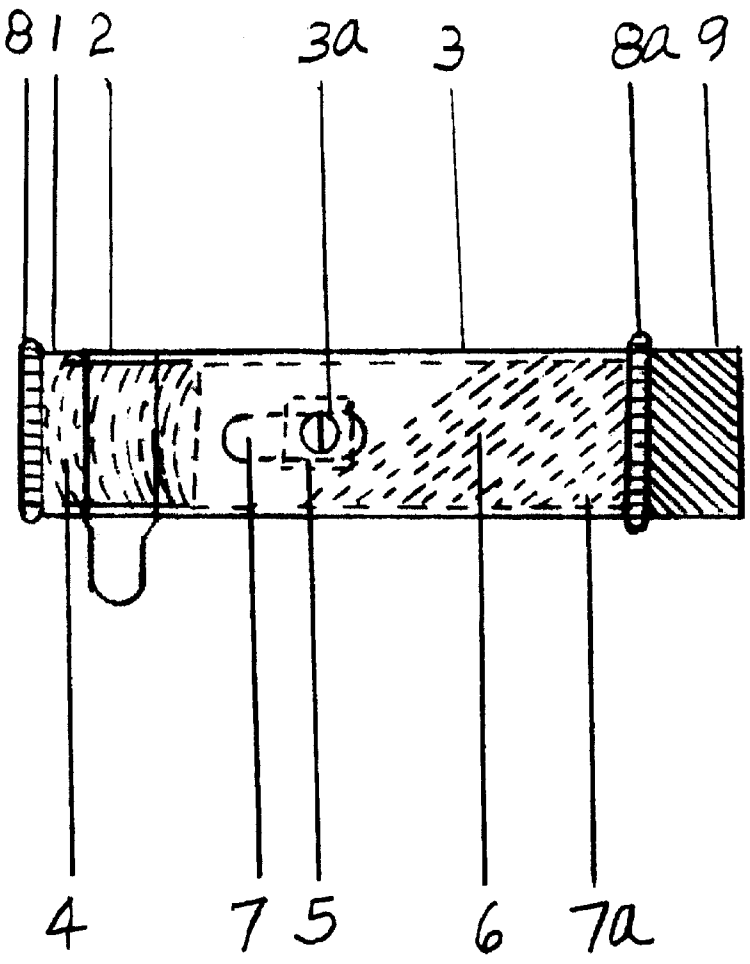
FIG. 2 is a view of the firearm port block in the compressed position.
Figure 4:
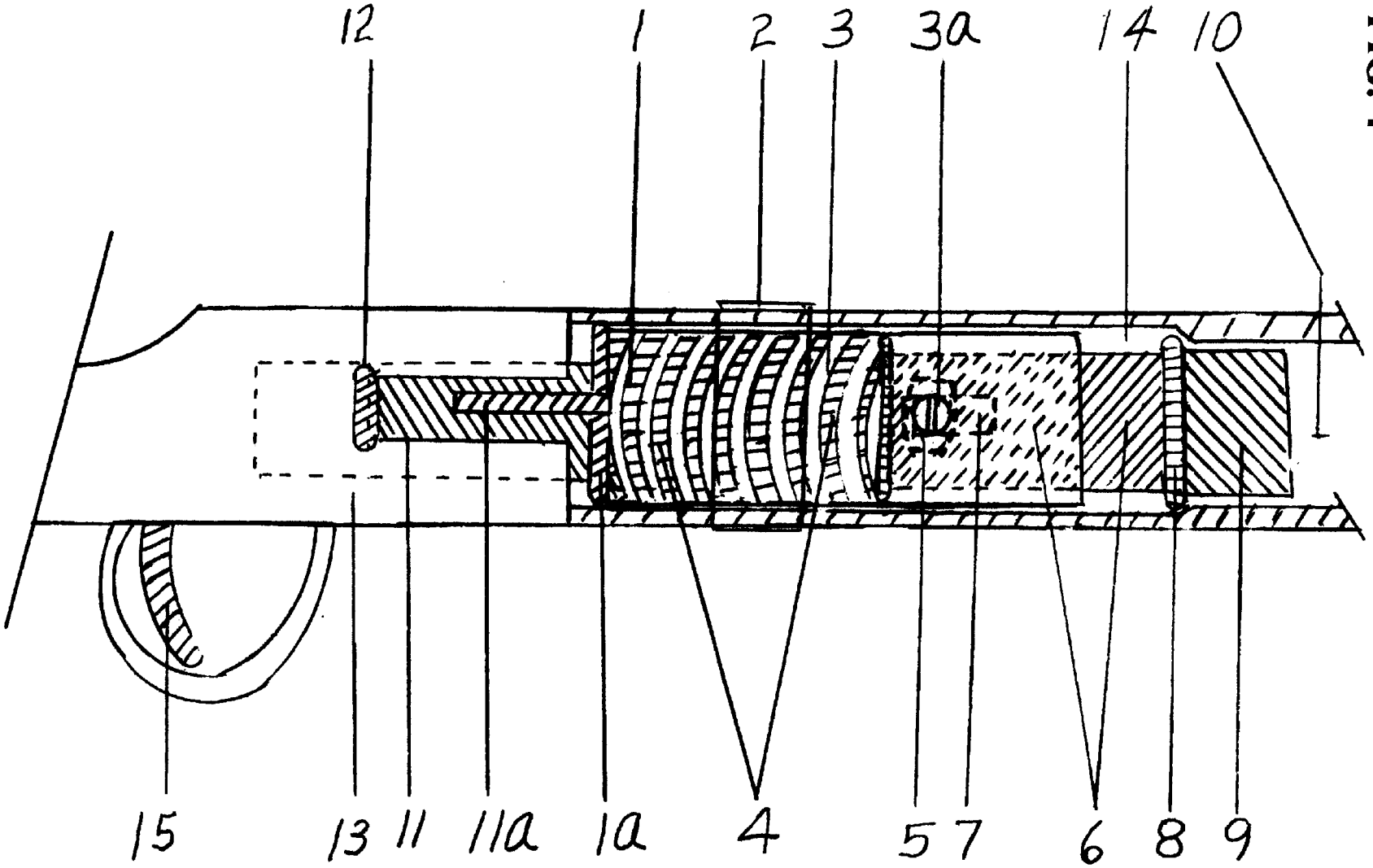
FIG. 4 is a view of the firearm port block, in a locked position, inside a weapons port.

The tension (lock) screw 3*a* is designed to lock the canister locking tube 6 in the expanded position (locked), FIG. 2 or contracted position (unlocked), FIG. 3. There are two parts to the locking system, the tension lock screw 3*a* and the tension nut 5. The tension nut 5 is positioned inside the canister locking tube 7*a*. When the tension nut 5 is placed in the canister locking tube 6 the end of the canister locking tube 6 is sealed 6*a*. The canister locking tube 6 is inserted into the shell canister 1, against canister spring 4 and by applying inward pressure the canister locking tube 6, align locking nut 5 and canister locking tube slot 7 with holes 5*a* and insert 3*a* through the canister shell 1, screwing 3*a* through the tension nut and the opposite hole of 5*a*. By loosening tension (lock) screw 3*a* it allows expansion of the canister spring 4, in turn expands the canister locking tube 6 and by turning tension (lock) screw 3*a* clock-wise, provides a locked position when inserted into a weapon's open port (FIG. 4, 14). By turning the tension (lock) screw 3*a* counter clock-wise and using the positioning tab 2, apply inward pressure toward the canister locking tube 6, the canister locking tube 6 will move against the canister spring 4, and by turning the tension (lock) screw 3*a* clock-wise, will allow contraction of the firearm port block 3 and provide clearance for removal of the firearm port block 3 from the weapons port 14.

The canister locking tube 6 is a cylindrical tube with a diameter size smaller than the diameter size of shell canister tube 1. The canister locking tube 6 is designed to traverse inside the tube of shell canister tube 1. There is a diagonal slot 7 on one side of the canister locking tube 6 with the slots 7 opening nearest the end that enters the open end of shell canister 1*b*. This diagonal slot 7 has a diameter size that allows the tension (lock) screw 3*a* to enter. The diagonal slot 7 allows for expansion and contraction of the canister locking tube 6 and provides a means to position the tube 6 in the locked or unlocked mode. The canister locking tube 6 has a closed end 6*a* that allows pressure to be applied by the canister spring 4. The canister locking tube 6 has a raised cap rim 8*a* that allows for stoppage of the firing chamber shell cap 9 when entering the weapon's firing chamber (FIG. 4, 10). The firing chamber shell cap 9 acts as a lock when expanded into a weapons firing chamber (FIG. 3, 9).

FIG. 2 is a side view of the Firearm Port Block 3 in the closed position. In this position the canister spring 4 is compressed by applying inward pressure to the canister locking tube 6 and tightening the tension lock screw 3*a* clockwise. By holding the positioning tab 2 the Firearm Port Block 3 may be inserted into the weapon's open port 14.

FIG. 3 is a side view of the Firearm Port Block 3 in the open position. In this position turning the tension lock screw 3*a* counter-clockwise, thus expanding the canister spring 4 that moves the canister locking tube 6 and inserts the firing chamber shell cap 9 into the weapon's firing chamber (FIG. 4, 10).

FIG. 4 is an oversized side view of a firearm 13 with the Firearm Port Block 3 in the expanded or locked position. In the aforementioned, the bolt 11 is in the shell extraction location of the open port 14 and the shell ejector 11*a* is positioned on the canister cap 1*a* of the Firearm Port Block 3. The canister spring 4 applies outward pressure against the canister locking tube 6 that expands the firing chamber shell cap 9 into the weapon's firing chamber 10, thus securing the firearm from being discharged. The tension (lock) screw 3*a* is rotated clockwise to the lock position. The tension (lock) screw 3*a* may use a keyed lock to maintain security.

What is claimed is:

1. What I claim as my invention is a firearm safety apparatus that prevents a weapon having a firing chamber, muzzle, and a barrel from being fired comprising, in combination:

a cylindrical device positioned snuggly in a firearm's open port to prevent the insertion of a live round into said firing chamber;

a shell canister sufficient in length to support an elongated canister locking tube with raised rims on each end and when placed into the open port of a firearm, and expanded, prevents the firearm from being discharged;

a positioning tab attached to the shell canister which allows the user to place the firearm port block inside the open port to secure the firearm from being fired;

a firearm safety apparatus that has a canister spring within the shell canister for traversing the canister locking tube between an expanded locked position and a contracted unlocked position; and the canister locking tube having a raised cap supporting a raised rim to prevent the injection of live ammunition into a firearm-firing chamber;

said firearm safety apparatus is designed to fit all open port firearms.

* * * * *